United States Patent [19]

Seipel

[11] 4,419,648

[45] Dec. 6, 1983

[54] CURRENT CONTROLLED VARIABLE REACTOR

[75] Inventor: Winfried Seipel, Lebanon Township, Hunterdon County, N.J.

[73] Assignee: Hewlett-Packard Company, Palo Alto, Calif.

[21] Appl. No.: 257,018

[22] Filed: Apr. 24, 1981

[51] Int. Cl.[3] ..... H01H 85/50

[52] U.S. Cl. ..... 336/215; 323/250; 336/165; 336/184

[58] Field of Search ..... 336/184, 180, 212, 214, 336/215, 178, 165, 160; 323/250, 251, 252, 334

[56] References Cited

U.S. PATENT DOCUMENTS

| | | | |
|---|---|---|---|
| 3,361,956 | 1/1968 | Sola | 336/165 X |
| 3,403,323 | 9/1968 | Wanlass | 323/250 |
| 3,659,191 | 9/1972 | Spreadbury | 336/215 X |
| 4,041,431 | 8/1977 | Enokson | 336/215 X |
| 4,177,418 | 12/1979 | Brueckner et al. | 336/215 X |
| 4,308,495 | 12/1981 | Yasumura | 323/250 |

FOREIGN PATENT DOCUMENTS

| | | | |
|---|---|---|---|
| 897860 | 11/1953 | Fed. Rep. of Germany | 336/215 |

*Primary Examiner*—R. L. Moses

*Attorney, Agent, or Firm*—Donald N. Timbie

[57] ABSTRACT

A variable reactor having main windings wound on one set of legs of a magnetic core and control windings mounted on another set of legs. The core provides common paths for the control flux resulting from the control windings and the main windings, but the magnetic circuit for the flux caused by the control windings does not include the legs on which the main windings are wound.

7 Claims, 5 Drawing Figures

CURRENT CONTROLLED VARIABLE REACTOR

BACKGROUND OF THE INVENTION

This invention relates to an improved variable reactor for use in controlling the output voltage of a power supply such as described in U.S. patent application Ser. No. 070,479, filed on Aug. 28, 1979, in the name of Robert D. Peck and entitled "Power Supply". In such a supply, an unregulated DC voltage is produced by a rectifier coupled to the line and a chopper is coupled between the rectifier and a resonant circuit including the variable reactor. Regulation of the output voltage is achieved by varying the inductance of the reactor with power taken from the output. This is accomplished by passing current through a control winding that is mounted on the same core as the reactor winding. The power required is considerable in view of the fact that the core is gapped. Gapping is required for the following reason. At start-up, the inductance of the variable reactor has a maximum value because the core is unbiased and can restrict the power reaching the load to a point where it is insufficient to provide the current required in the control winding. This problem can be met even under the worst condition for start-up of minimum line voltage and maximum load by reducing the inductance with gaps in the core. Unfortunately, however, this may cause the maximum value of the inductance to be too low to produce the desired output voltage when the line voltage is a maximum and the load a minimum.

BRIEF DESCRIPTION OF THE INVENTION

In accordance with this invention, a core for a variable reactor is made of magnetic material such as ferrite and is shaped to provide a first pair of legs having gaps in them, a second pair of legs, a first structure providing paths for magnetic flux between given ends of said first and second pairs of legs, and a second structure providing paths for magnetic flux between the other ends of said first and second pairs of legs. A reactor is formed by respectively providing serially connected reactor windings on said first pair of legs and serially connected control windings in said second pair of legs. The structures for providing flux paths between the ends of the legs are preferably planar plates having openings in the central area thereof so as to cause flux produced by said reactor and control windings to flow in essentially parallel paths. This causes the hysteresis produced by the control windings to be in the same general path as the flux produced by the reactor windings, thereby increasing the control effect.

With a reactor as just described, the gaps can be such as to make the unbiased inductance of the reactor windings sufficiently large under a condition of maximum line voltage and minimum load without impairing start-up. Even though the power delivered to the load is small, very little current is required in the control winding to bias the core because the flux does not have to flow through the gapped legs as in previous reactors.

DETAILED DESCRIPTION OF THE INVENTION

Figure 1:
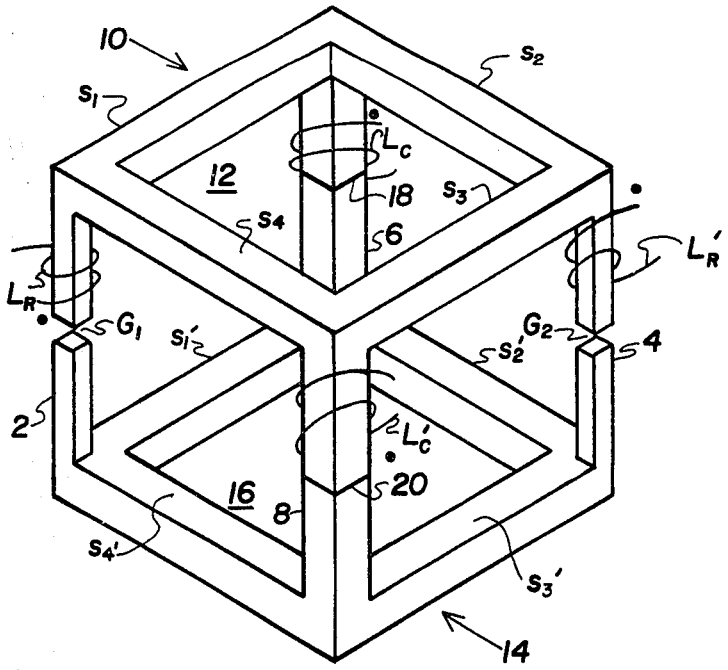
FIGS. 1 and 2 illustrate different forms of a core constructed in accordance with the invention.

In all the figures of the drawing, corresponding parts are designated in the same manner.

The core shown in FIG. 1 is made of magnetic material such as ferrite and is comprised of a first pair of legs 2 and 4 that are located at the diagonal corners of a rectangle and have gaps $G_1$ and $G_2$ respectively. A second pair of legs 6 and 8 are located at the ends of the other diagonal. A structure 10 is herein shown as a planar plate having a rectangular opening 12 therein so as to form a frame having members $s_1$, $s_2$, $s_3$ and $s_4$ that respectively provide magnetic flux paths between the upper ends of the legs 2,6; 6,4; 4,8 and 8,2; and a structure 14 is herein shown as a planar plate having a rectangular opening 16 therein so as to form a frame having members $s_1'$, $s_2'$, $s_3'$ and $s_4'$ that respectively provide magnetic flux pathsbetween the lower ends of the legs 2,6; 6,4; 4,8 and 8,2. The structures 10 and 14 are shown as being rectangular frames perpendicular to the legs 2, 4, 6 and 8 in order to simplify construction, but the structures 10 and 14 need not be planar or rectangular and the legs 2, 4, 6 and 8 need not be parallel or at the ends of diagonals of a rectangle. The core as shown may be molded in two halves with approximately half of each leg extending perpendicularly from the structures 10 and 14. The portions of the legs 2 and 4 respectively joined to the structures 10 and 14 are shorter than the portions of the legs 6 and 8 so as to form the gaps $G_1$ and $G_2$ when the molded halves are mounted with the legs 6 and 8 in contact with each other as shown by lines 18 and 20.

Reactor windings $L_R$ and $L_R'$ are respectively wound on the gapped legs 2 and 4; and control windings $L_C$ and $L_C'$ are respectively wound on the ungapped or continuous legs 6 and 8. Although not shown, the reactor windings $L_R$ and $L_R'$ are connected in series as are the control windings $L_C$ and $L_C'$. The winding senses of the windings $L_R$ and $L_R'$ are such as to cause magnetic flux to have opposite directions in the legs 2 and 4; and the winding senses of the windings $L_C$ and $L_C'$ are as indicated by the dots so as to cause magnetic flux to have opposite directions in the legs 6 and 8.

Figure 2:
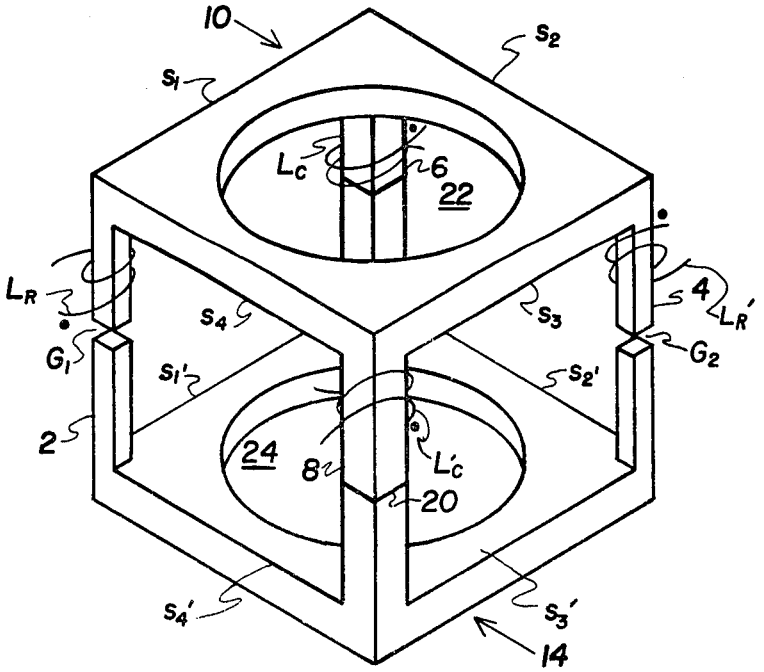

The only difference between the core shown in FIG. 2 and the core shown in FIG. 1 is that, in the latter, the openings 22 and 24 in the structures 10 and 14 are circular rather than rectangular.

Figure 3:
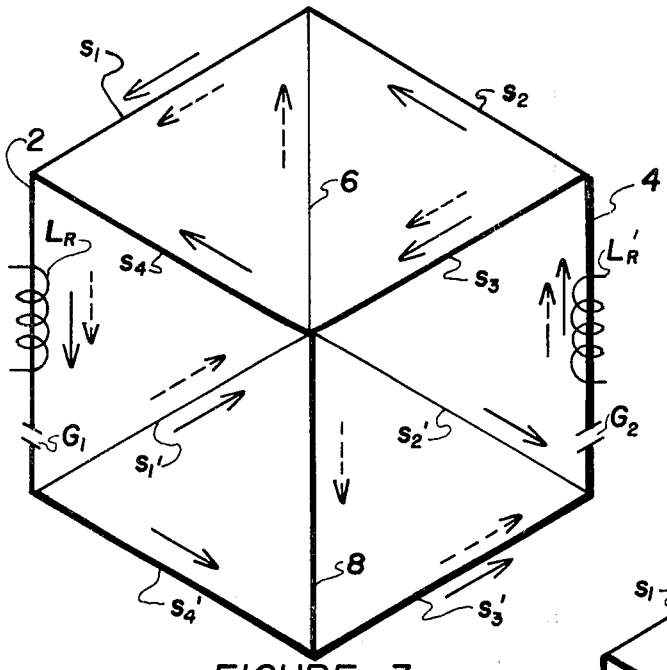
FIG. 3 illustrates the paths of the flux due to one half-cycle of current in the reactor windings.
Figure 4:
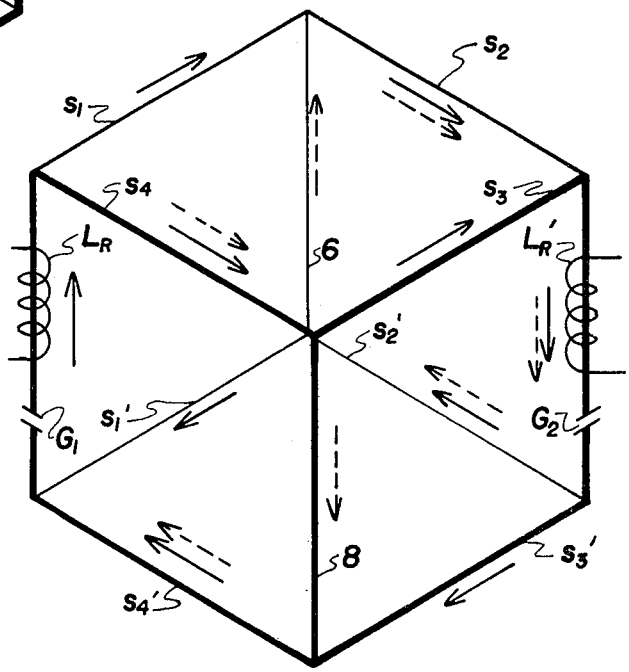
FIG. 4 illustrates the paths of the flux due to the other half-cycle of current in the reactor windings.
Figure 5:
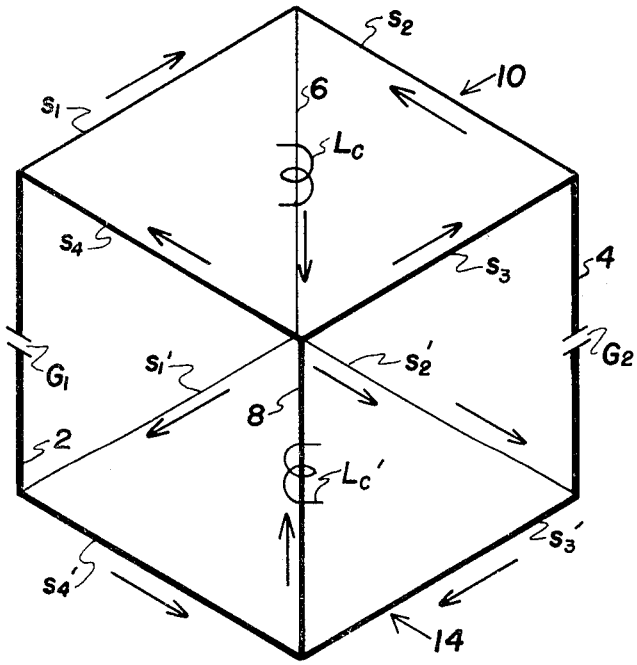
FIG. 5 illustrates the paths followed by the flux due to DC current in the control winding.

A brief explanation of the reactors of FIGS. 1 and 2 will now be given by reference to FIGS. 3, 4 and 5 in which the magnetic flux paths are shown for ease in illustration as being straight lines and the direction of the flux in each path is indicated by an arrow. FIG. 3 illustrates the AC flux due to one half of a cycle of AC current in the reactor windings $L_R$ and $L_R'$, and FIG. 4 illustrates the AC flux due to the other half of a cycle of AC current. FIG. 5 illustrates the DC flux caused by a DC current in the control windings $L_C$ and $L_C'$. When the AC flux in a path is in the same direction as the DC flux, little AC flux flows because the core material is driven more into saturation, but when the AC flux in a path is in the opposite direction as the DC flux, more of it flows because the core material is driven to a condition of less saturation. Thus, during the half-cycles of current in the windings $L_R$ and $L_R'$ that are respectively illustrated in FIGS. 3 and 4, the AC flux mainly follows the dotted arrows. During the half-cycle illustrated in FIG. 3, the flux produced by $L_R$ flows in the path at the left rear of the core, and the flux produced by $L_R'$ flows in the paths at the right front of the core. During the half-cycle illustrated in FIG. 4, the flux produced by $L_R$ flows in the paths at the left front of the core, and the flux produced by $L_R'$ flows in the paths at the right rear of the core.

Of greatest importance, however, is the fact that there is a complete circuit for the DC flux produced by the control windings $L_C$ and $L_C'$ that excludes the first pair of legs 2 and 4 having the gaps $G_1$ and $G_2$, but includes portions of the paths in which there is AC flux so that control can be established. Because the DC flux does not have to flow through the gaps $G_1$ and $G_2$, less current is required in the control windings $L_C$ and $L_C'$ to make the parts of the core containing both DC and AC flux have the desired permeability.

The structures 10 and 14 of FIGS. 1 and 2 could be solid plates, but this would not work as well because the DC flux would flow along the direction of one diagonal and the AC flux along the other diagonal so that the DC flux component in common with the AC flux component would be smaller than it is in the structures 10 and 14 shown wherein the DC and AC flux are substantially parallel.

What is claimed is:

1. A variable reactor, comprising a first pair of legs, said legs having gaps therein, a second pair of legs that are free of gaps, a first structure providing paths for magnetic flux between given ends of said first and second pairs of legs, a second structure providing paths for magnetic flux between the other ends of said first and second pairs of legs, serially connected reactor windings respectively wound on each of said first pair of legs, and serially connected control windings respectively wound on each of said second pair of legs.

2. A core as set forth in claim 1 wherein said first and second structures are each comprised of a plate.

3. A core as set forth in claim 2 wherein there are holes contained in each of said plates so as to reduce the amount of flux that respectively flows directly between the legs of each pair.

4. A core of magnetic material for a variable inductive reactor, comprising a first pair of legs having gaps therein, a second pair of legs free from gaps, a first structure forming a complete magnetic circuit, one set of ends of said first and second pairs of legs joining said first magnetic circuit at different points, and a second structure forming a complete magnetic circuit, the other set of ends of said first and second pairs of legs joining said second magnetic circuit at different points.

5. A core as set forth in claim 4 wherein said first and second structures are each comprised of a plate.

6. A core as set forth in claim 4 wherein there are holes contained in each of said plates so as to reduce the amount of flux that respectively flows directly between the legs of each pair.

7. A variable reactor having a core as set forth in any of claims 4, 5 or 6 and having serially connected reactor windings respectively wound on each of said first pair of legs and serially connected control windings respectively wound on each of said second pair of legs.

* * * * *